US006371384B1

(12) United States Patent
Garcia

(10) Patent No.: US 6,371,384 B1
(45) Date of Patent: Apr. 16, 2002

(54) AQUEOUS FOAM GENERATING SYSTEM AND METHOD FOR GENERATING FOAM HAVING LONG WET-TO-DRY TRANSITION TIMES

(75) Inventor: Felipe Garcia, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/571,881

(22) Filed: May 16, 2000

(51) Int. Cl.[7] ..... A62C 5/02

(52) U.S. Cl. ..... 239/10; 239/310; 239/304; 169/44

(58) Field of Search ..... 239/310, 303, 239/304, 308, 316, 318, 349, 10; 169/13, 14, 15, 44; 252/8.05, 3, 8

(56) References Cited

U.S. PATENT DOCUMENTS 3,647,001 A * 3/1972 Livingston ..... 169/14
4,802,630 A * 2/1989 Kromrey ..... 239/428
4,859,349 A * 8/1989 Clark et al. ..... 252/3
4,981,178 A * 1/1991 Bundy ..... 169/13
5,258,137 A * 11/1993 Bonekamp ..... 252/8.05
6,155,351 A * 12/2000 Breedlove ..... 169/14

* cited by examiner

*Primary Examiner*—David A. Scherbel
*Assistant Examiner*—Dinh Q. Nguyen
(74) *Attorney, Agent, or Firm*—Harvey A. Gilbert; Donald G. Peck

(57) ABSTRACT

An aqueous foam generating system and method are provided. A first solution has particles of a carbomer resin encapsulated within an anhydrous, non-polar, organic hydrophobic surfactant. A second solution, capable of ionizing the carbomer resin, is pumped into an eductor which draws a volumetric portion of the first solution to form a mixture that is sprayed from an aerator to form an aqueous foam having long wet-to-dry transition times.

16 Claims, 1 Drawing Sheet

AQUEOUS FOAM GENERATING SYSTEM AND METHOD FOR GENERATING FOAM HAVING LONG WET-TO-DRY TRANSITION TIMES

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to foam and foam generating systems, and more particularly to an aqueous foam generating system and method for generating a foam that exhibits wet-to-dry transition times on the order of days rather than minutes or hours.

BACKGROUND OF THE INVENTION

A foam can be described as a mass of gas bubbles in a liquid-film matrix. Two factors control the ability of a liquid to foam under mechanical agitation: (a) surface tension, and (b) the presence of impurities in the liquid itself. Surface tension is the condition used to describe the net result of attractive intramolecular forces (i.e., dipolar and Van der Waals forces) over the surface of a liquid and is measured in dynes/cm or Joules/cm$^2$. The net result of unbalanced molecular forces near the surface provide the necessary additional energy to provide an increased liquid surface area. However, the increased liquid surface area that could be obtained through the surface tension effect is minimal even with mechanical agitation unless a surfactant is added.

Surfactants can be hydrophobic or hydrophilic. For the case of hydrophobic surfactants, the surfactant molecules migrate to the air-water interface because the surface is energetically favored for the surfactant as compared to the water molecules. As a result of this migration, the surface tension of the water/surfactant system is significantly decreased from that of water alone. From a thermodynamic standpoint, the addition of the surface film actually decreases the total internal energy of the system to the point that a metastable system (i.e., foam) can exist by virtue of the reduced tensile force acting on each foam cell. However, due to the low viscosity of water, a wet-cell to dry-cell transition takes place within minutes of creation of an aqueous foam. For the above reasons, conventional aqueous foams are not suitable for uses such as explosive blast containment, firefighting, toxic substance containment, frost damage prevention for crops/plants, etc., since the desirable water mass is lost within minutes of foam placement.

SUMMARY OF THE INVENTION

Accordingly, it is an object of the present invention to provide a foam having an extended wet-to-dry transition time.

Another object of the present invention is to provide a slow draining aqueous foam.

Still another object of the present invention is to provide a method of making an aqueous foam.

Yet another object of the present invention is to provide an aqueous foam generation system.

A further object of the present invention is to provide a method and system of making an aqueous foam that has wet-to-dry transition times on the order of days.

Yet another object of the present invention is to provide an improved aqueous foam that can be made using conventional foam making equipment.

Other objects and advantages of the present invention will become more obvious hereinafter in the specification and drawings.

In accordance with the present invention, an aqueous foam generating system and method are provided. A first solution provides particles of a carbomer resin encapsulated within an anhydrous, non-polar, organic hydrophobic surfactant. A second solution provides a neutralizing liquid having a ph in the range of approximately 5–11. The second solution must be capable of ionizing the carbomer resin. The second solution is pumped into an eductor which draws a volumetric portion of the first solution into the second solution being pumped through the eductor. As a result, a mixture of the first solution and second solution exits the eductor. An aerator coupled to the output of the eductor sprays the mixture to form an aqueous foam. Some time after the foam is formed and deployed, a chemical reaction takes place. This chemical reaction increases the viscosity of water and modifies its flow characteristics from a Newtonian flow to a high-yield-plastic flow at the foam unit cell with no density changes. Wet-to-dry foam transition of the improved foam system occurs mainly through surface evaporation which is a very slow process.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
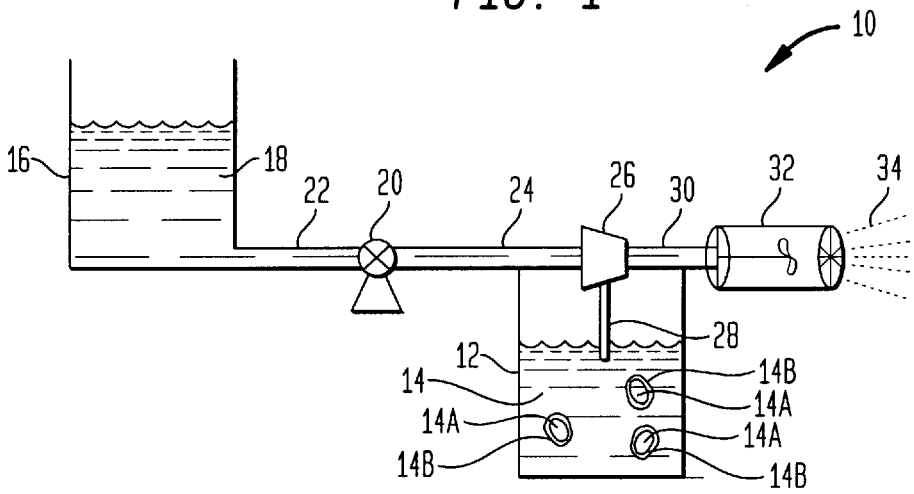
FIG. 1 is a schematic view of an aqueous foam generating system according to the present invention.

Referring now to the drawings, and more particularly to FIG. 1, an aqueous foam generating system according to the present invention is shown and referenced generally by numeral 10. The general construction of system 10 will first be described, followed by a description of the operating principles and methods associated therewith.

Foam generating system 10 has a first container 12 filled with a solution 14 of a surfactant mixed with a carbomer resin. More specifically, as illustrated in size-exaggerated fashion, solution 14 consists of particles 14A of a carbomer resin that have been coated or encapsulated within an anhydrous, non-polar, organic hydrophobic surfactant 14B.

For example, surfactant 14B could be hydrocarbon based. Since carbomer resins 14A are extremely water-loving or hydrophilic, encapsulation thereof by surfactant 14B creates a stable barrier that prevents premature waterabsorption/thickening of carbomer resins 14A and provides a convenient form for handling and use in system 10.

Figure 2:
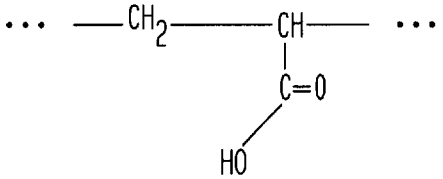
FIG. 2 is a schematic view of the basic monomer structure of a carbomer resin.

Carbomer resin 14A is type of acrylic acid polymer having the basic monomer structure illustrated in FIG. 2.

The total molecular weight of carbomer resins ranges between approximately 450,000 to 4,000,000 grams/gram-mole depending on the length of the polymeric chain. A variety of carbomer resins are available commercially in powder form from B.F. Goodrich Company, Cleveland, Ohio, under the trademark CARBOPOL.

A second container 16 is filled with a neutralizing liquid 18 that, when mixed with solution 14, will cause carbomer resin 14A to ionize as will be explained further below. In general, neutralizing liquid 18 is a water-based liquid/solution having a ph in the range of approximately 5–11. More specifically, neutralizing liquid 18 is water mixed with a base material such as, but not limited to, sodium hydroxide, potassium hydroxide, ammonium hydroxide, amines, and alkanolamines.

The inlet of a pump 20 is coupled via conduit 22 to neutralizing liquid 18 in container 16. The outlet of pump 20 is coupled via conduit 24 to the primary input of an eductor 26. A secondary input of eductor 26 is coupled via conduit 28 to solution 14 in container 12. The output of eductor 26 is coupled via conduit 30 to the input of an aerator 32. Eductor 26 and aerator 32 are standard elements/components in a foam generating system, are commercially-available from a variety of sources, and would be well understood by one of ordinary skill in the art. Accordingly, no further description of these two devices will be provided herein.

In operation, neutralizing liquid 18 is pumped by pump 20 through eductor 26. As neutralizing liquid 18 passes through eductor 26, a volume of solution 14 is drawn up into eductor 26 where it mixes with neutralizing liquid 18 starting the ionization of carbomer resins 14A in solution 14. The mixture of solution 14/neutralizing liquid 18 exits eductor 26 and is passed via conduit 30 to aerator 32 where the mixture is sprayed therefrom as an aqueous foam 34.

Figure 3:
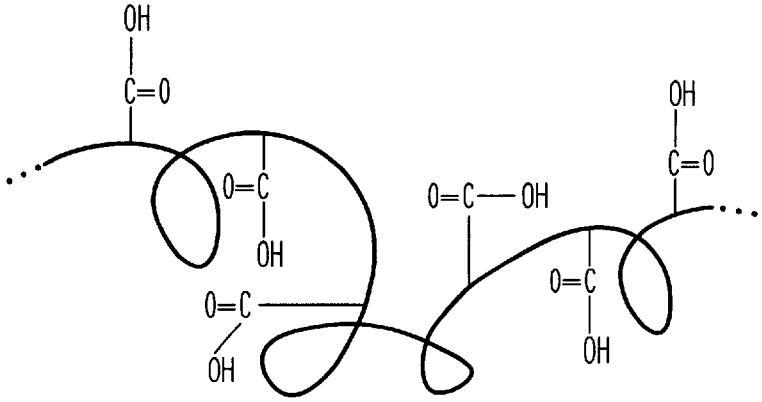
FIG. 3 is a schematic view of a molecule of a carbomer resin in its relaxed, presolvated state.
Figure 4:
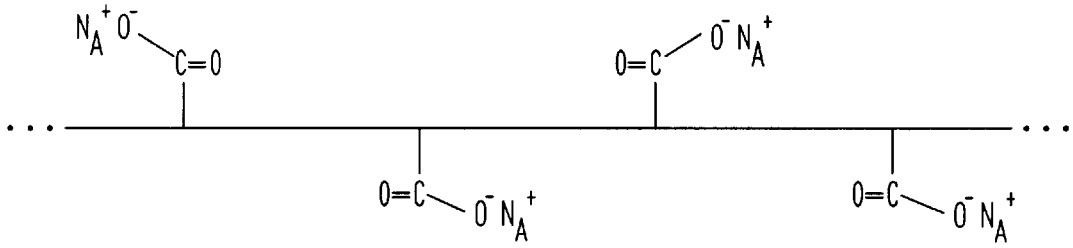
FIG. 4 is a schematic view of a molecule of a carbomer resin in its uncoiled state after being mixed with a solution of water and sodium hydroxide.

The operating principles of the present invention will now be presented. As is known in the art, the molecule of a carbomer resin in its presolvated state is a tightly coiled micelle as illustrated in FIG. 3 where the "—$CH_2$—CH—" bond is not shown for simplicity and clarity of illustration. The thickening (i.e., increased viscosity) capabilities of the presolvated carbomer resin are limited because of its confined structure. Once dispersed in water, the carbomer resin molecule is hydrated and uncoils to a certain extent as the water's hydrogen bonds with the carbomer resin. To further increase the "thickening" of the carbomer resin, the water can be mixed with an inorganic base (e.g., sodium hydroxide) as described above. The presence of the (neutralizing) inorganic base ionizes the carbomer resin and generates negative charges along the backbone of the polymer. Repulsion of like charges causes uncoiling of the molecule into an extended structure such as that shown in FIG. 4 when a neutralizing solution of water and sodium hydroxide is used. This reaction takes only a few seconds to complete and increases the viscosity of water up to 80,000 Brookfield $V_{20}$cP. Note that maximum viscosities for most carbomer resins are achieved when the ph of the neutralizing solution is approximately 7.

Since the intent of the present invention is to generate an aqueous foam that prevents or slows the wet-to-dry transition, viscosity of the foam is not the desired fluid property that needs to be optimized. Fluid systems that do not flow until the applied stress exceeds a certain minimum value are known as plastic-flow fluids. (Other fluid systems such as water flow immediately when stress is applied and continue to flow until the energy of the system is in equilibrium.) For plastic-flow fluids, the certain minimum stress value which is required in order to initiate flow is called the yield value of the fluid. The yield value is a measure of internal molecular energy due to the result of internal molecular attractive forces and is measured as dynes/$cm^2$ or Joules/$cm^3$. Surface tension and yield value are both measures of internal molecular energy due to the net result of attractive intramolecular forces, with surface tensions (Joules/$cm^2$) being a unit of energy per area and yield value (Joules/$cm^3$) being a unit of energy per volume. Based on this specific information, a chemical explanation can be presented to explain the observed extended drainage times of the foam generated in accordance with the present invention.

As a result of solution 18 (e.g., water and sodium hydroxide) being pumped through eductor 26, solution 14 (e.g, . the surfactant and the carbomer resin) is injected through aerator 32. Knowing that the sodium hydroxide and the surfactant are impurities, the surface energy of the water is lowered from the normal $72.75\times10^{-7}$ Joules/$cm^2$, and a foam system is produced. Mixing of the encapsulated carbomer resin and the sodium hydroxide aqueous solution takes place through the delivery system, while the chemical reaction therebetween continues for some time after foam delivery. This reaction takes place during a period of time that can be manipulated using a combination of different carbomer resins, concentration of reactants, temperature of the reactants, or delivery velocities (as described by basic chemical kinetics principles). Using the proper chemical conditions, the delivered foam, through a chemical neutralization reaction at each unit cell, experiences the following changes: (a) the viscosity of the aqueous system around each foam cell increases by a factor of approximately 200 with actual viscosity about 70,000 Brookfield $V_{20}$cP and (b) the yield value of the aqueous system around each foam cell increase from 0 (no yield value) to over $700\times10^{-7}$ Joules/$cm^3$.

A foam system exists due to the lower energy state induced by the lower surface tension/energy produced by the surfactant. Through chemical energy/reaction, the decay of the potential energy of the system (i.e., water drainage out of the foam unit cell) is delayed by the increased viscosity and yield value of the foam unit cell. The energy of the water system is increased when the foam system is produced. Under normal conditions, the system is metastable and drainage occurs shortly in order to reach a lower energy equilibrium state. However, under the circumstances outlined herein, the energy of the improved foam system is increased even higher than normal, while the decay from that higher energy state is very slow due to the increased viscosity and yield value of the foam. As a result, it can be stated that the potential energy decay (i.e., water drainage) of a metastable foam system could be delayed by the rearrangement of micellar structures within the walls of the foam unit cell in order to increase the viscosity and change the flow properties of the fluid to that of a plastic-flow over all of the foam unit cell.

In specific testing of the present invention, a high molecular weight carbomer (e.g., CARBOPOL 940 from B.F. Goodrich Company having a molecular weight of 4,000,000 grams/gram-mole) was mixed with an anhydrous, non-polar, organic hydrophobic surfactant (e.g., ULTRAFOAM V available from Wifarm, LLC, Gladstone, Mo.). A weight ratio of surfactant-to-carbomer of approximately 10-to-1 was used. The neutralizing liquid was solution of water and sodium hydroxide. For the illustrated example, approximately 420 grams of sodium hydroxide per 100 liters of water were mixed together in solution. In generating the foam in a system such as system 10, flows were adjusted so that the volume of solution 14 comprised approximately 5% by volume of the mixture of solution 14 and neutralizing solution 18 in and downstream of eductor 26. The resulting foam generated by this example had a wet-to-dry transition time of several days.

The advantages of the present invention are numerous. The present system and method provide the means to generate a foam that has longer drainage times, i.e., transition from wet-to-dry foam. The unique approach described herein increases the viscosity of water and modifies its flow characteristics from a Newtonian flow to a high-yield-plastic flow at the foam unit cell with no density changes while using commonly available foam dispensing equipment. Wet-to-dry foam transition of the improved foam system occurs mainly through surface evaporation which is a very slow process when compared to water drainage that occurs for other foam systems. Thus, the present invention will find great utility in explosive blast containment, firefighting, or any other application where it is desirable for the water mass to remain in the foam for a relatively long time.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. An aqueous foam generating system comprising:

a first solution of particles of a carbomer resin encapsulated within an anhydrous, non-polar, organic hydrophobic surfactant;

a second solution of a neutralizing liquid having a ph in the range of approximately 5–11, said second solution being capable of ionizing said carbomer resin;

an eductor having a primary input, a secondary input and an output coupled to said primary input and said secondary input, said secondary input being coupled to said first solution;

a pump for pumping said second solution into said primary input of said eductor, wherein a volumetric portion of said first solution is drawn into said second solution being pumped into said primary output, and wherein a mixture of said first solution and said second solution exits said eductor at said output; and an aerator coupled to said output of said eductor for spraying said mixture wherein an aqueous foam is formed by said mixture so-sprayed.

2. An aqueous foam generating system as in claim 1 wherein said carbomer resin has a molecular weight between approximately 450,000 and 4,000,000 grams/gram-mole.

3. An aqueous foam generating system as in claim 1 wherein said second solution comprises water mixed with a base material.

4. An aqueous foam generating system as in claim 3 wherein said base material is selected from the group consisting of sodium hydroxide, potassium hydroxide, ammonium hydroxide, amines and alkanolamines.

5. An aqueous foam generating system as in claim 1 wherein said second solution has a ph of approximately 7.

6. An aqueous foam generating system as in claim 1 wherein said second solution comprises approximately 420 grams of sodium hydroxide per 100 liters of water.

7. An aqueous foam generating system as in claim 1 wherein said first solution has a surfactant-to-carbomer resin weight ratio of approximately 10 to 1.

8. An aqueous foam generating system as in claim 1 wherein said volumetric portion comprises approximately 5% by volume of said mixture.

9. A method of making an aqueous foam, comprising the steps of:

providing a first solution of particles of a carbomer resin encapsulated within an anhydrous, non-polar, organic hydrophobic surfactant;

providing a second solution of a neutralizing liquid having a ph in the range of approximately 5–11, said second solution being capable of ionizing said carbomer resin;

pumping said second solution through an eductor that is coupled to said first solution, wherein a volumetric portion of said first solution is drawn into said second solution, and wherein a mixture of said first solution and said second solution exits said eductor; and passing said mixture through an aerator wherein said mixture is sprayed therefrom to form an aqueous foam.

10. A method according to claim 9 wherein said carbomer resin has a molecular weight between approximately 450,000 and 4,000,000 grams/gram-mole.

11. A method according to claim 9 wherein said second solution comprises water mixed with a base material.

12. A method according to claim 11 wherein said base material is selected from the group consisting of sodium hydroxide, potassium hydroxide, ammonium hydroxide, amines and alkanolamines.

13. A method according to claim 9 wherein said second solution has a ph of approximately 7.

14. A method according to claim 9 wherein said step of providing said second solution comprises the step of mixing approximately 420 grams of sodium hydroxide per 100 liters of water.

15. A method according to claim 9 wherein said first solution has a surfactant-to-carbomer resin weight ratio of approximately 10 to 1.

16. A method according to claim 9 wherein said volumetric portion comprises approximately 5% by volume of said mixture.

* * * * *